US006678943B1

(12) United States Patent
Feng et al.

(10) Patent No.: US 6,678,943 B1
(45) Date of Patent: Jan. 20, 2004

(54) METHOD OF MANUFACTURING A MICROELECTROMECHANICAL SWITCH

(75) Inventors: Milton Feng, Champaign, IL (US); Shyh-Chiang Shen, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 423 days.

(21) Appl. No.: 09/686,349

(22) Filed: Oct. 10, 2000

Related U.S. Application Data

(62) Division of application No. 09/326,771, filed on Jun. 4, 1999, now Pat. No. 6,143,997.

(51) Int. Cl.[7] ..... H01H 65/00

(52) U.S. Cl. ..... 29/622; 29/600; 29/592.1; 200/181; 333/262

(58) Field of Search ..... 29/600, 622, 846, 29/592.1, 831; 200/181, 600; 333/101, 105, 262

(56) References Cited

U.S. PATENT DOCUMENTS 4,674,180 A * 6/1987 Zavracky et al. ..... 29/622
4,959,515 A 9/1990 Zavracky et al.
5,168,249 A 12/1992 Larson
5,258,591 A * 11/1993 Buck ..... 200/181
5,578,976 A * 11/1996 Yao ..... 333/262
5,677,823 A * 10/1997 Smith ..... 361/234
6,046,659 A * 4/2000 Loo et al. ..... 333/262
6,074,890 A * 6/2000 Yao et al. ..... 438/52
6,143,997 A * 11/2000 Feng et al. ..... 200/181
6,376,787 B1 * 4/2002 Martin et al. ..... 200/181

OTHER PUBLICATIONS

C.L. Goldsmith, Z. Yao, S. Eshelman, D. Denniston, "Performance of Low–Loss RF MEMS Capacitive Switches" *IEEE Microwave and Guides Wave Letters*, vol. 8, No. 8, Aug. 1988.

(List continued on next page.)

*Primary Examiner*—Carl J. Arbes
*Assistant Examiner*—Minh Trinh
(74) *Attorney, Agent, or Firm*—Greer, Burns & Crain, Ltd.

(57) ABSTRACT

A method for controlling the flow of signals by selectively switching signals to ground and allowing signals to pass through a signal line based a position of a conductive pad. The method includes the steps of forming a conductive coplanar signal line and ground planes, depositing a first release layer over the signal line and ground planes, and forming a conductive pad spanning portions of both the signal line and ground planes on the first release layer. The method also includes the steps of forming a second release layer over the conductive pad, forming two sets of holes through the first and second release layers down to the ground planes with the two sets of holes being formed around portions of the conductive path, and forming a dielectric suspension in a first set of the two sets of holes. The method further includes the steps of forming a metal contact on the dielectric suspension, forming a metal bracket in the second set of the two sets of holes, and removing the first and second release layers to release the conductive pad.

7 Claims, 10 Drawing Sheets

OTHER PUBLICATIONS

N.S. Barker, G.M. Rebeiz, "Distributed MEMS True–Time Delay Phase Shifters and Wide–Bank Switches", *IEEE Transactions on Microwave Theory and Techniques*, vol. 46, No. 11, Nov. 1988, pp. 1881–1890.

E.R. Brown, "RF–MEMS Switches for Reconfigurable Integrated Circuits", *IEEE Transactions on Microwave Theory and Techniques*, vol. 46, No. 11, Nov. 1998, pp. 1868–1880.

J.J. Yao, M.F. Chang, "A Surface Micromachined Miniature Switch for Telecommunications Applications with Signal Frequencies from DC up to 4 GHz", IEEE conference paper, 1995.

C. Goldsmith, T.H. Lin, B. Powers, W.R. Wu, B. Norvell, "Micromechanical Membrane Switches for Microwave Applications", *IEEE MTT–S Digest*, 1995, pp. 91–94.

C. Goldsmith Z. Yao, S. Eshelman, D. Denniston, S. Chen, J. Ehmke, A. Malczewski, R. Richards, "Micromachining of RF Devices for Microwave Applications", Raytheon TI Systems Materials.

J.J. Yao, S.T. Park, J. DeNatale, "High Tuning–Ratio MEMS–Based Tunable Capacitors for RF Communications Applications", Solid State Sensor and Actuator Workshop, Hilton Head Island, South Carolina, Jun. 8, 1998.

* cited by examiner

Fig. 8A

| DEVICE PARAMETER | | PRESENT DIMENSION | MINIMUM POSSIBLE DIMENSION | MAXIMUM POSSIBLE DIMENSION | COMMENTS |
|---|---|---|---|---|---|
| WIDTH ($\mu$m) | SWITCH | 100,150 | 0.1 | 1000 | NOT NECESSARILY RECTANGULAR IN SHAPE |
| | ELECTRODE | 100,150 | 0.1 | 1000 | |
| LENGTH ($\mu$m) | SWITCH | 450 | 2 | 1000 | |
| | ELECTRODE | 200,150, 100,50 | 2 | 1000 | |
| DIELECTRIC LAYER THICKNESS ($\mu$m) | | 0 | 0 | 30 | |
| CLEARANCE BETWEEN TOP AND BOTTOM ELECTRODES ($\mu$m) | | 4 | 1 | 1000 | |

Fig. 9

| | CANTILEVER (ROCKWELL) | MEMBRANE (TT) | HINGE TYPE (UIUC) |
|---|---|---|---|
| FREQUENCY (GHz) | 4 | 20 ~ 35 | 50 |
| RON(Ω) | N/A | 0.35 | 0.3 |
| COFF (pF) | N/A | 35 | 30 |
| CUTOFF FREQUENCY (GHz) | N/A | >9000 | >10,000 |
| INSERTION LOSS (dB) | 0.1 | 0.14 ~ 0.17 | 0.2 |
| ISOLATION (dB) | 50 | 24 ~ 35 | 30 |
| CAPACITANCE RATIO | N/A | 80 ~ 110 | ~100 |
| SWITCHING SPEED (μs) | 30 | <2 | 2 |
| SWITCHING VOLTAGE (V) | 28 | 30 ~ 50 | <3 |
| SIZE ($\mu m^2$) | (200X200)X2 | 280X170 | 450 X 100<br>450 X 150 |

METHOD OF MANUFACTURING A MICROELECTROMECHANICAL SWITCH

This is a division of Ser. No. 09/326,771 filed Jun. 4, 1999 now U.S. Pat. No. 6,143,997.

STATEMENT OF GOVERNMENT INTEREST

This invention was made with the assistance of the Defense Advanced Research Project Agency, under contract no. DARPA F30602-97-0328. The Government has certain rights in this invention.

FIELD OF THE INVENTION

The present invention generally concerns switches. More specifically, the present invention concerns microelectromechanical switches that are capable of switching at low actuation voltages.

BACKGROUND OF THE INVENTION

Switching operations are a fundamental part of many electrical, mechanical, and electromechanical applications. Microelectromechanical systems (MEMS) for switching applications have drawn much interest especially within the last few years. Products using MEMS technology are widespread in biomedical, aerospace, and communication systems. Recently, the MEMS applications for radio frequency (RF) communication systems have gained even more attention because of the MEMS's superior characteristics. RF MEMS have advantages over traditional active-device-based communication systems due to their low insertion loss, high linearity, and broad bandwidth performance.

Known MEMS utilize cantilever switch, membrane switch, and tunable capacitors structures. Such devices, however, encounter problems because their structure and innate material properties necessitate high actuation voltages to activate the switch. These MEMS devices require voltages ranging from 10 to 100 Volts. Such high voltage operation is far beyond standard Monolithic Microwave Integrated Circuit (MMIC) operation, which is around 5 Volts direct current (DC) biased operation.

Known cantilever and membrane switches are shown in FIGS. 1 and 2 in resting and excited positions. FIG. 1A shows a cantilever switch in a resting position with a cantilever portion a distance $h_A$ away from an RF transmission line to produce an off state since the distance $h_A$ prevents current from flowing from the cantilever to the transmission line below it. To turn the switch on, a large switching voltage, typically in the order of 28 Volts, is necessary to overcome physical properties and bend the metal down to contact the RF transmission line (FIG. 1B). In the excited state, with the metal bent down, an electrical connection is produced between the cantilever portion and the transmission line. Thus, the antilever switch is on when it exists in the excited state.

In addition, referring to FIGS. 2A and 2B, a known membrane switch is shown in a resting (FIG. 2A) and an excited (FIG. 2B) position. When the membrane switch exists in the resting position, current is unable to flow from the membrane to an output pad and the switch is off. Like the cantilever switch, a high actuation voltage, typically 38 to 50 Volts, is necessary to deform the metal and activate the switch. In the excited state, the membrane is deformed to contact a dielectric layer on the output pad and thereby electrically connect the membrane to the output pad to turn the switch on. These designs also require a relatively high voltage.

There is a need for an improved apparatus and method which addresses some or all of the aforementioned drawbacks of known switches. Importantly, a new apparatus and method should overcome the need for high actuation voltages. In addition, the apparatus and method should overcome the limitations of traditional active-device-based switches.

SUMMARY OF THE INVENTION

Such needs are met or exceeded by the present apparatus and method for switching. The present system controls the flow of a signal with a metal or other suitable conductive pad that moves freely up and down within brackets, without the need for deformation. The pad electrically grounds a signal when the pad is located in a relaxed position (contacts closed) and allows the signal to pass when located in a stimulated position (contacts open). The present invention includes electrodes that move the pad up and down with a low actuation voltage compared to known devices. The pad is not bent by the actuation voltage to make contact.

More specifically, in a preferred embodiment, the present invention controls the flow of signals by either shorting the signals to ground or allowing the signal pass through a signal line. The switch contains coplanar or other waveguides including the signal line and ground planes. The metal pad responds to an actuation voltage to electrically connect the signal line and the ground planes when the metal pad is in the relaxed position. When not located in the relaxed position, the switch allows signals to flow through the signal line unimpeded. Brackets guide the metal pad as the metal pad moves between the relaxed position and a stimulated position in response to the actuation voltage.

BRIEF DESCRIPTION OF THE DRAWINGS

Other features and advantages of the invention will be apparent to those skilled in the art with reference to the detailed description and the drawings, of which:

FIG. 8A is a table of possible dimensions for the switch of the present invention;

FIG. 9 is a table comparing the capabilities of known switches with the RF MEMS switch of the present invention.

TABLE OF ACRONYMS

This patent utilizes several acronyms. The following table is provided to aid the reader in understanding the acronyms:

C=Centigrade.

DC=direct current.

MEMS=microelectromechanical system.

MMIC=Monolithic Microwave Integrated Circuit.

PECVD=Plasma-Enhanced Chemical vapor deposition.

RF=radio frequency.

DETAILED DESCRIPTION OF THE PREFERRED EMBODIMENTS

Generally, the present invention is an apparatus and method for controlling the flow of signals. More specifically, the method and apparatus is a switch which is easy to produce and does not rely on the deformation of at least part of the system to activate the switch. Thus, the switch can be activated with a low voltage compared to known MEMS.

Figure 1A:
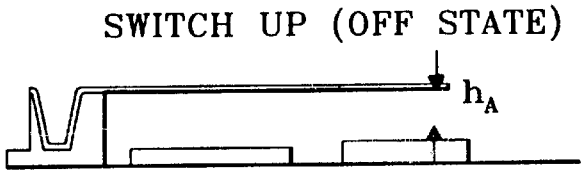
Fig. 1A (PRIOR ART)
FIGS. 1A and 1B show a known cantilever switch shown in an off and on state respectively.
Figure 1B:
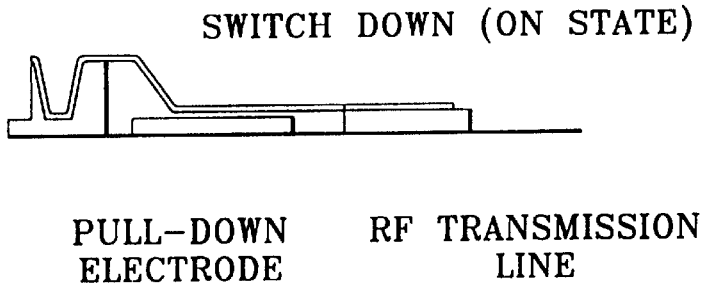
Fig. 1B (PRIOR ART)
Figure 2A:
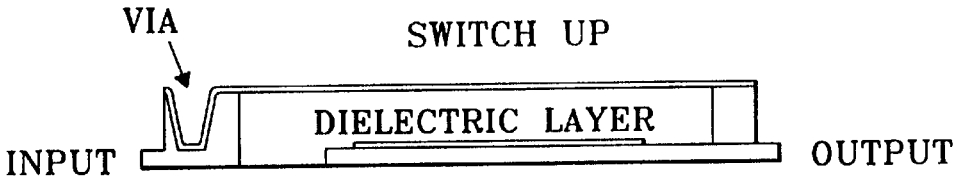
Fig. 2A (PRIOR ART)
FIGS. 2A and 2B show a known membrane switch shown in an off and on state respectively.
Figure 2B:
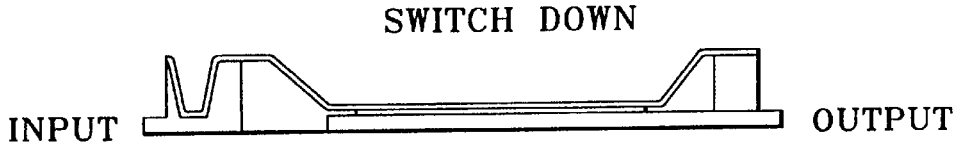
Fig. 2B (PRIOR ART)
Figure 3A:
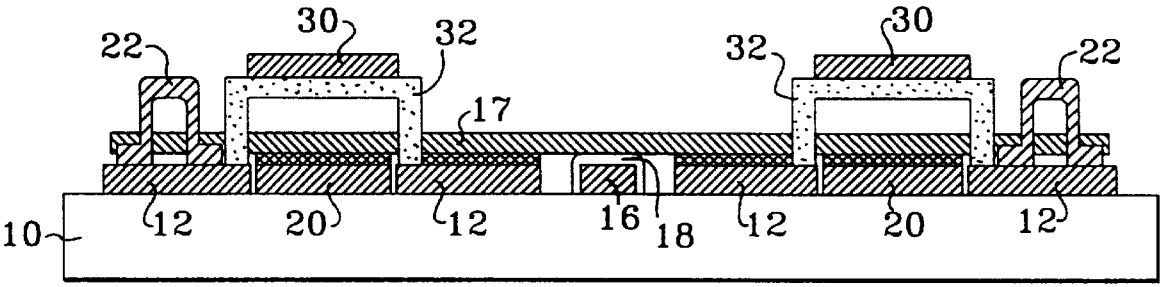
FIG. 3A is a schematic cross-sectional side view of a preferred embodiment of a switch of the present invention in a pad down (contacts closed) position.
Figure 3B:
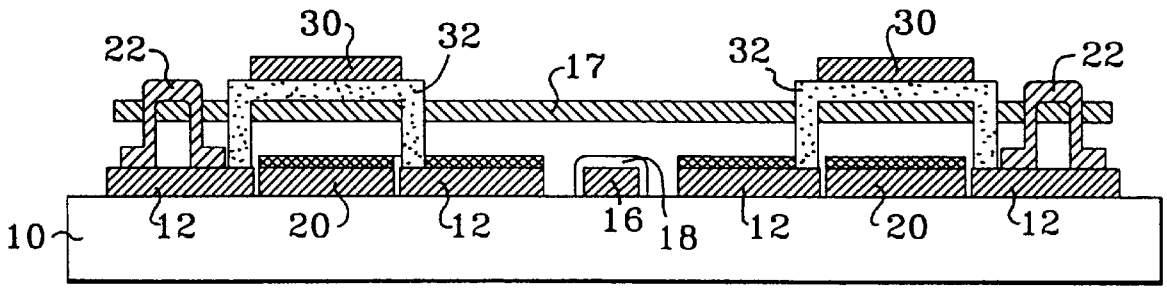
FIG. 3B is the same side view as FIG. 3A of the present invention in a pad up (contacts open) position.

Referring now to the drawings, and particularly FIGS. 3A and 3B, the switch of the present invention includes a substrate base 10. Any type of substrate used in semiconductor fabrication can be applied to the present invention such as silicon, GaAs, InP, GaN, sapphire, quartz, glasses, and polymers. Upon the substrate base 10 are waveguides which include one or two ground planes 12 and a signal line 16. Any form of contacts used in integrated circuits can be used with the present invention, including coplanar waveguides and microstrip waveguides. For purposes of describing the invention, coplanar waveguides are shown.

The ground planes 12 pass signals, for example RF signals, from the signal line 16 to ground when the switch is in a relaxed (contacts closed) position, to produce an off state. While the present invention is described with regard to RF signals, it should be appreciated that other signals can be used, including low frequencies, millimeter-wave frequencies, and sub-millimeter-wave frequencies. The invention can be used for broad-band switching applications. To pass RF signals to ground, a conductive pad 17 is moveably positioned to contact both the signal line 16 and the ground planes 12 when the pad is in the relaxed position (FIG. 3A). The pad 17 is preferably made of metal, but can be made of any other suitable material. As shown with arrows, the input RF signal enters from an input port 16*a* (shown best in FIGS. 4–6), flows through the pad 17, and then flows to ground by the ground planes 12. Therefore, no RF signal flows through the output port 16*b* and the switch exists in an off state. Thus, unlike known MEMS, an off state occurs when the metal pad 17 is in a relaxed (contacts closed) position.

Preferably, a thin dielectric layer 18 is positioned between the signal line 16 and the metal pad 17 to serve as a DC blocking capacitor. A zero dielectric thickness corresponds to a physical short in the switch. A non-zero dielectric thickness corresponds to a capacitively coupled shunt switch, i.e., effectively a low-pass filter or an RF short. Any type of dielectric material can be applied, such as silicon dioxide, silicon nitride, pyralene, polymers, glasses and the like. In addition, bottom electrodes 20 can be inserted between the pad 17 and ground planes 12, to enhance contact by attracting the pad 17 towards the waveguides.

Figure 4A:
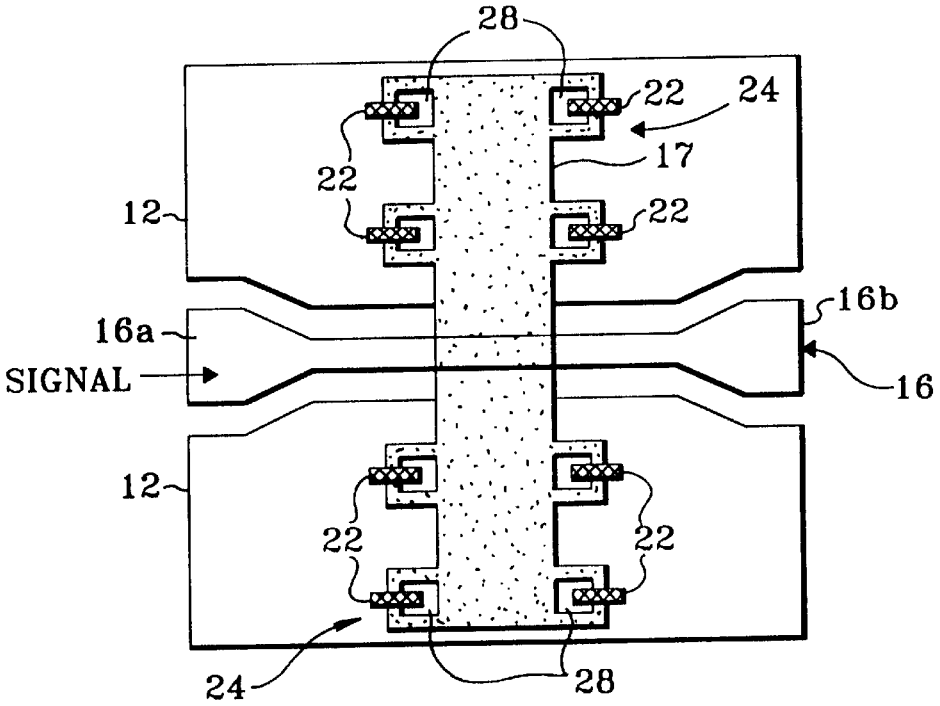
FIG. 4A is a schematic top view showing hinge brackets of the present invention located on sides of a conductive pad.
Figure 4B:
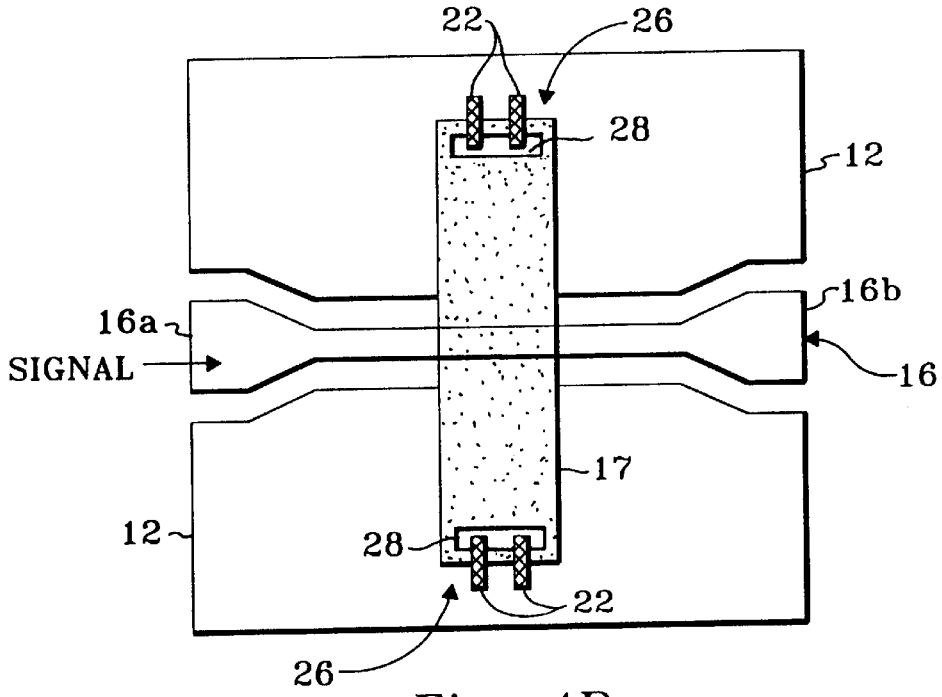
FIG. 4B is a schematic top view showing hinge brackets of the present invention located on the ends of the conductive pad.

Importantly, the pad 17 moves up and down freely with only the forces of gravity and air resistance to keep the metal pad 17 down. To guide movement of the pad 17, the pad 17 is slidably positioned with brackets 22. Preferably, the brackets 22 are placed atop the ground planes 12, and may be placed on any side of the metal pad 17. Referring to FIGS. 4A and 4B, brackets 22 are placed on sides 24 of the metal pad in FIG. 4A, and at ends 26 of the pad in FIG. 4B. As shown, each bracket 22 fits within an access hole 28 formed in the pad 17, to capture the pad 17 while allowing it to freely slide between its relaxed and excited positions.

Figure 5:
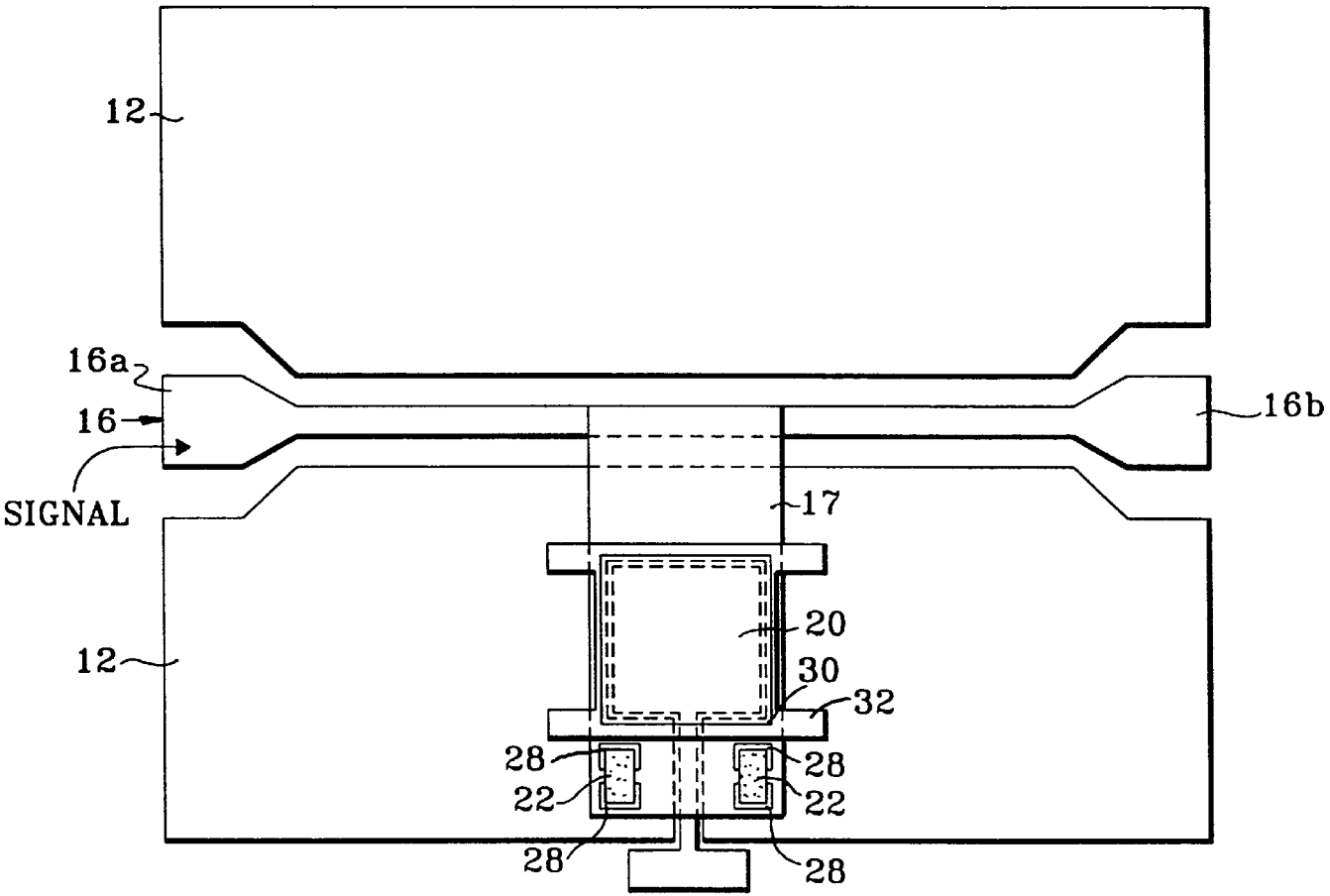
FIG. 5 is a schematic top view of an alternate embodiinent of the hinge brackets of the present invention.

FIG. 5 shows a device which is similar to the device of FIGS. 3A and 3B, but is one-sided. One or more brackets 22 can be fabricated within one or two access openings 28 formed on one end of the pad 17. Preferably, when two brackets and openings are used, as in FIG. 5, spacing between access holes is equal to or less than 25 $\mu$m. For the hinge type switch of the present invention, two sacrificial layers each having a thickness of around 2 $\mu$m are used. To remove the layers successfully, spacing between openings should be less than 15 $\mu$m in all directions. It can be appreciated that the brackets 22 are designed with consideration given to a sacrificial layer removal capability and mechanical strength. Thus, the layer should be robust enough to contain the pad 17 while maintaining its physical integrity as the pad moves up and down, yet be easily removed by etching during a masking process described below.

Figure 6A:
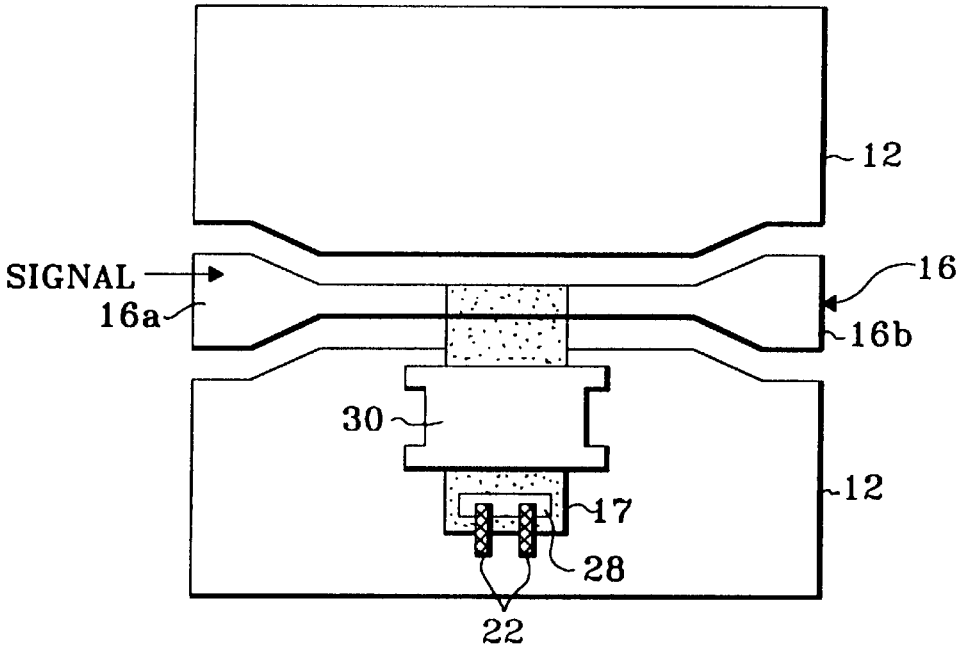
FIGS. 6A and 6B are schematic top views respectively showing one-sided and two-sided hinge structures of the present invention.
Figure 6B:
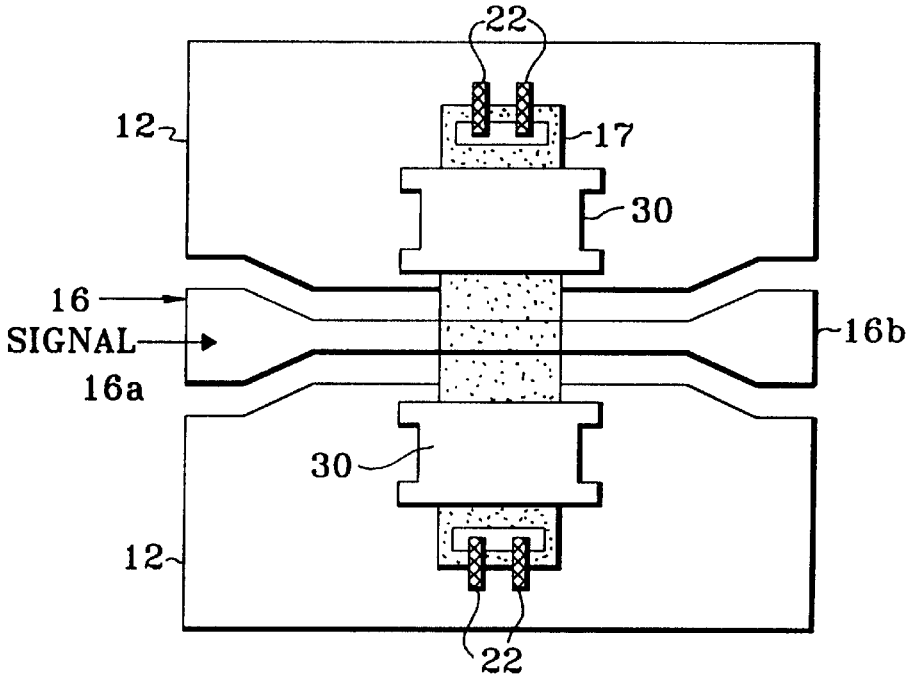

Referring now to FIGS. 6A and 6B, bracket structures which secure the conductive pad 17 through a single opening 28 are shown applied to a one sided switch (FIG. 6A) and a two sided switch (FIG. 6B).

Referring again to FIGS. 3A and 3B, the switch system includes top electrodes 30 which sit atop dielectric suspensions 32. Any suitable type of dielectric material can be used as the dielectric suspensions such as silicon dioxide, silicon nitride, pyralene, polymers, and glasses. Preferably, the dielectric suspensions 32 are positioned on the ground planes 12. Actuation voltage is applied alternately to the top electrode 30 and bottom electrode 20 to provide electrostatic force that causes the metal pad to move, preferably in an up and down direction. It should be appreciated, however, that an operation of the switch does not depend on the metal pad moving in the up and down direction. Since the minimum required electrostatic forces produced by the actuation voltage is approximately equal to the sum of the gravitation and the air friction forces on the pad 17, the applied voltage is much less than that necessary for the cantilever and membrane structures described above. Thus, a small actuation voltage, e.g., less than 3 Volts, for RF MEMS devices is achieved.

The conductive pad 17 is attracted upward when a small voltage, e.g., less than 3 Volts, is applied to top electrodes 30 (FIG. 3B). A clearance between the bottom electrodes 20 and the top electrodes 30 affects the necessary actuation voltage such that a larger clearance necessitates a greater actuation voltage. When the pad 17 is in the excited position (contacts open), RF signals flow unimpeded from the input port 16*a* to the output port 16*b* through signal line 16, as shown by the arrows, with only a negligible loss to the signal. In a preferred embodiment, this position corresponds to the switch on state. Thus, unlike known switches, the present switch is on when electrical contact is disengaged. In addition, since the actuation voltage is small, the present invention operates in either a normally on or in a normally off mode by applying DC voltage to either side of an actuation pad. The switching operation can be realized by applying two out-of-phase pulses at the top and bottom actuation electrodes.

Now referring to FIGS. 7A–7K, shown is a multi-level process for constructing hinge type RF MEMS switches.

Figure 7A:
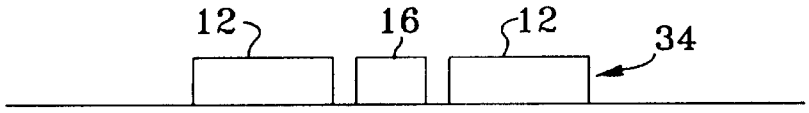
FIGS. 7A–7K are side views showing a process for manufacturing a switch of the present invention.
Figure 7B:
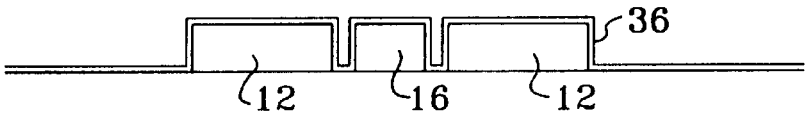
Figure 7C:
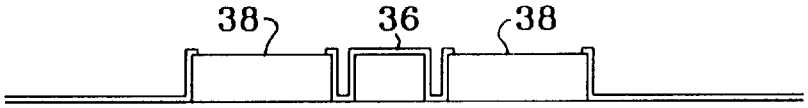

Preferably, the temperatures for the fabrication process are controlled to be not higher than 300 degrees centigrade (C), to allow the integration compatibility of the current MMIC process. First, in FIG. 7A coplanar waveguides, i.e., ground planes 12 and signal line 16, are defined and a first layer of metal 34, for example gold, is evaporated on the coplanar waveguides. FIG. 7B shows a thin dielectric layer 36 deposited. VIA holes 38 are opened, as in FIG. 7C.

Figure 7D:
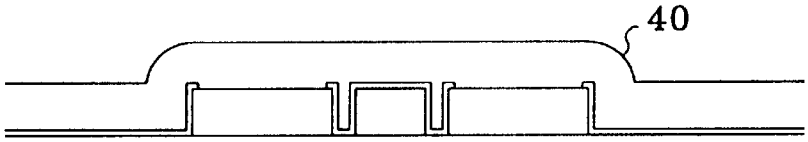
Figure 7E:
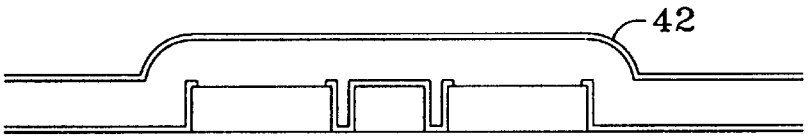
Figure 7F:
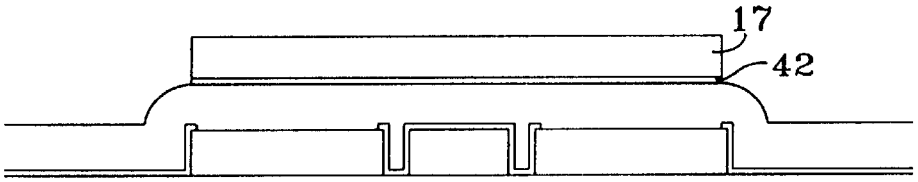
Figure 7G:
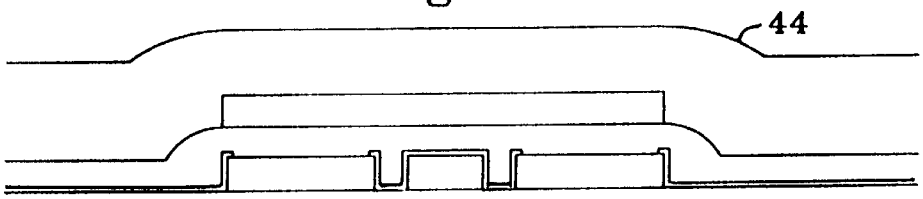
Figure 7H:
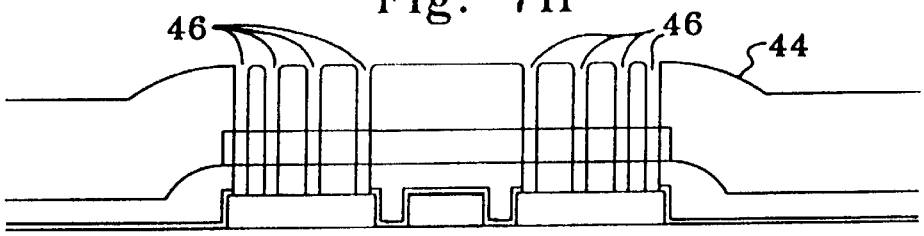
Figure 7I:
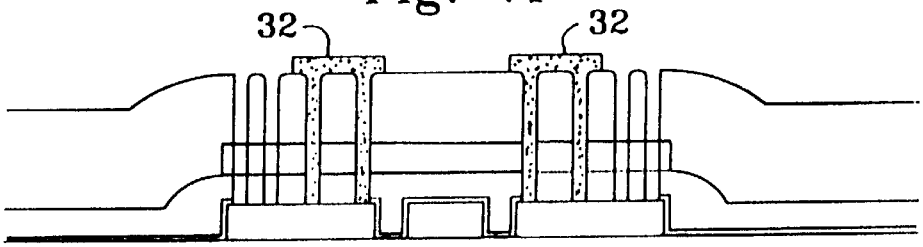
Figure 7J:
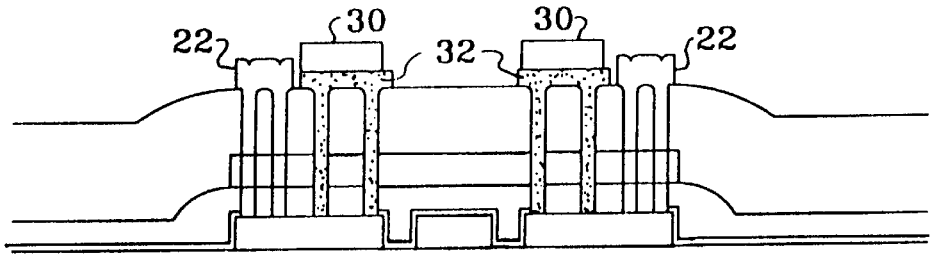
Figure 7K:
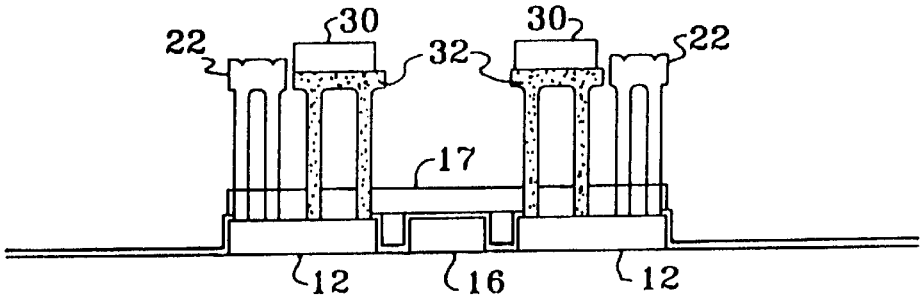

A first polyimide layer 40 is spun-on and cured as shown in FIG. 7D, and a third layer of metal 42 is added, as in FIG. 7E. A metal pad is formed as in FIG. 7F, after which exposed portions of the layer 42 are evaporated. In FIGS. 7G and 7H, a second layer of polyimide 44 is spun-on and the post areas holes 46 are defined for the dielectric suspensions 32 of the top electrodes 30 and for hinge structures. Then a thick dielectric layer is grown by PECVD to define the dielectric suspensions 32, as shown in FIG. 7I. FIG. 7J shows a third metal layer evaporated to form the hinge brackets 22 and top electrodes 30. Finally, FIG. 7K shows the polyimides etched away to release the whole structure of the present switch. The approximate processing time for sacrificial layer removal is controlled to be within about two hours or less.

Figure 8B:
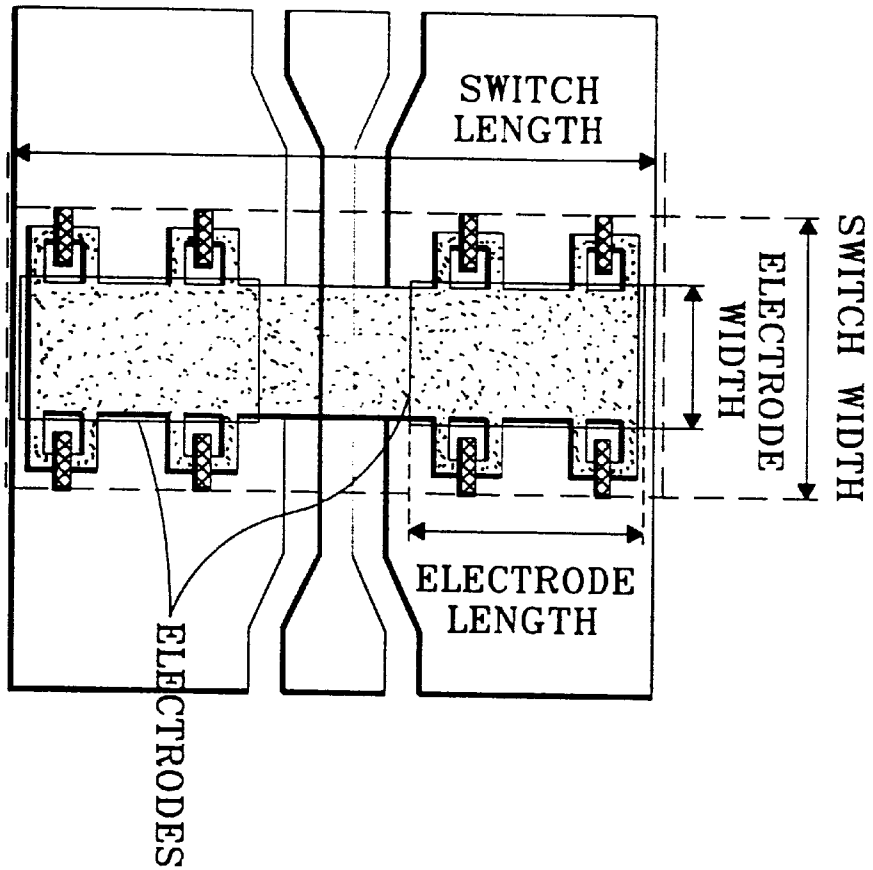
FIG. 8B is a schematic top view which identifies the dimensions shown in FIG. 8B.

Referring now to FIGS. 8A and 8B, various parameters are considered in the layout design which lead to the dimensions of the device. Artisans will appreciate that the device is not limited to a rectangular shape, but can be any geometry including a polygon, circle, or ellipse. Since the switch is designed for capacitive coupling operations as well as direct connections, the capacitance should be as large as possible to allow a switch down state. Thus, a contact area of the signal line 16 and metal pad 17 should be as large as possible to gain a wider operation bandwidth and lower impedance at high frequency regime.

A width of the metal pad 17 can overlap a width of the signal line 16. However, large overlap areas cause greater insertion loss in the switch up state. It is noted that coplanar waveguide characteristics with a signal line width of 20 $\mu$m, 50 $\mu$m, and 100 $\mu$m are viable (not shown). A width of the top electrodes 30 was chosen at 100 $\mu$m and 150 $\mu$m. Combined with the different coplanar waveguide structures, six different impedance sets are available.

Bottom electrodes 20 are inserted on the ground planes 12 of coplanar waveguides and are surrounded by the ground planes 12. A bigger electrode requires a lower actuation voltage. The ground plane 12 should be big enough to sustain 50 $\Omega$ impedance over the coplanar waveguides. Typically, a width of the ground plane is about 300 $\mu$m.

Referring now to FIG. 9, a table shows expectations for the present invention compared to known cantilever and membrane type switches. Of particular interest, note that a required switching voltage is less than 3 Volts for the present invention, and 28 to 50 Volts for the known switches. Thus, it should be understood that an improved switch has been shown and described.

From the foregoing description, it should be understood that an improved microelectromechanical switch has been shown and described which has many desirable attributes and advantages. It is adapted to switch the flow of a signal based on a relaxed or stimulated position of a metal pad. Unlike known prior art, a signal flow of the present switch is off when the metal pad makes a connection and on when the connection is breached. In addition, the present switch responds to a low actuation voltage of 3 Volts or less. The invention is also easy to manufacture.

Other alterations and modifications will be apparent to those skilled in the art. Accordingly, the scope of the invention is not limited to the specific embodiments used to illustrate the principles of the invention. Instead, the scope of the invention is properly determined by reference to the appended claims and any legal equivalents thereof.

What is claimed:

1. A method for forming a microelectromechanical switch to control the flow of signals, the method comprising steps of:

forming a conductive coplanar signal line and ground planes;

depositing a first release layer over the signal line and ground planes;

forming a conductive pad spanning portions of both the signal line and ground planes on the first release layer;

forming a second release layer over the conductive pad;

forming two sets of holes through the first and second release layers down to the ground planes, the two sets of holes being formed around portions of the conductive pad;

forming a dielectric suspension in a first set of the two sets of holes;

forming a metal contact on the dielectric suspension;

forming a metal bracket in a second set of the two sets of holes; and removing the first and second release layers to release the conductive pad.

2. The method according to claim 1, wherein said steps of forming a metal contact and forming a metal bracket are conducted simultaneously as part of a single metal deposit.

3. The method according to claim 1, further comprising step of depositing a dielectric coating on the signal line and ground planes prior to said step of depositing a first release layer.

4. The method according to claim 1, wherein said first and second release layers comprise polyimide and all steps are performed at temperatures of approximately 300° C.

5. The method according to claim 1, wherein the conductive pad is formed in a shape which includes access holes and the second set of holes aligns with the access holes to allow the metal bracket to fit through the access holes when formed.

6. The method according to claim 1, wherein:

the first set of holes defines holes for forming at least two dielectric suspensions and said step of forming a dielectric suspension forms at least two dielectric suspensions;

the second set of holes defines holes for forming at least two metal brackets and said step of forming a metal bracket forms at least two metal brackets.

7. The method according to claim 1, wherein the metal pad is formed to overlap the signal line.

* * * * *